US006424325B1

(12) United States Patent
Van Dijk

(10) Patent No.: US 6,424,325 B1
(45) **Date of Patent: *Jul. 23, 2002**

(54) CIRCUIT FOR AND METHOD OF DRIVING A FLAT PANEL DISPLAY IN A SUB FIELD MODE AND A FLAT PANEL DISPLAY WITH SUCH A CIRCUIT

(75) Inventor: Roy Van Dijk, Eindhoven (NL)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,158

(22) PCT Filed: Dec. 1, 1997

(86) PCT No.: PCT/IB97/01488

§ 371 (c)(1),
(2), (4) Date: Nov. 3, 1998

(87) PCT Pub. No.: WO98/39762

PCT Pub. Date: Sep. 11, 1998

(30) Foreign Application Priority Data

Mar. 7, 1997 (EP) ..... 97200691

(51) Int. Cl.[7] ..... G09G 3/28
(52) U.S. Cl. ..... 345/60
(58) Field of Search ..... 345/60, 63, 67, 345/68, 148; 315/169.1, 169.4, 169.3

(56) References Cited

U.S. PATENT DOCUMENTS 4,190,789 A * 2/1980 Kawada et al. ..... 315/169.4
4,368,465 A * 1/1983 Hirakawa et al. ..... 340/771
4,426,646 A * 1/1984 Yamaguchi et al. ..... 340/769
4,737,687 A * 4/1988 Shinoda et al. ..... 315/169.4
5,030,888 A * 7/1991 Salavin et al. ..... 315/169.4
5,541,618 A * 7/1996 Shinoda ..... 345/60
5,724,054 A * 3/1998 Shinoda ..... 345/60
5,745,086 A * 4/1998 Weber ..... 345/63
5,841,413 A * 11/1998 Zhu et al. ..... 345/63
5,874,932 A * 2/1999 Nagaoka et al. ..... 345/60
6,181,306 B1 * 1/2001 Specty et al. ..... 345/63
6,219,012 B1 * 4/2001 Holtslag ..... 345/60

FOREIGN PATENT DOCUMENTS

EP 0549275 B1 5/1997 ..... G09G/3/28
JP 07271325 A 10/1995 ..... G09G/3/28

OTHER PUBLICATIONS

"Improvement in PDP Picture Quality by Three–Dimensional Scattering of Dynamic False Contours", by T. Yamaguchi et al, SID 96 Digest, Publication 19.4, pp. 291–294.

* cited by examiner

*Primary Examiner*—Vijay Shankar
*Assistant Examiner*—Vanel Frenel

(57) ABSTRACT

A flat panel display (PD) comprises a plurality of display elements (C) arranged in a matrix of rows and columns, and electrodes (Sc, D, Su) associated to display elements (C) in a row or a column. The flat panel display (PD) is driven in a sub field mode wherein a field period (Tf) of a received display information (Pi) is divided (1) into consecutive sub field periods (Tsf) having an address period (Tp) preceding a display period (Ts). within a field period (Tf), a predetermined order of weight factors (Wf) each associated with a corresponding one of the display periods (Ts) is generated (1). The electrodes (Sc, D, Su) are interconnected in at least two groups (Sce, Sco; Sue, Suo). Drive signals corresponding to the weight factors (Wf) are supplied (2,3,4,5; 2,3,4, 5,6) to each of the at least two groups. Within a same field period (Tf), the predetermined order of weight factors (Wf) is adapted to associate a different order of weight factors (Wf) to the display periods (Ts) of the at least two groups of electrodes (Sce, Sco; Sue, Suo).

20 Claims, 5 Drawing Sheets

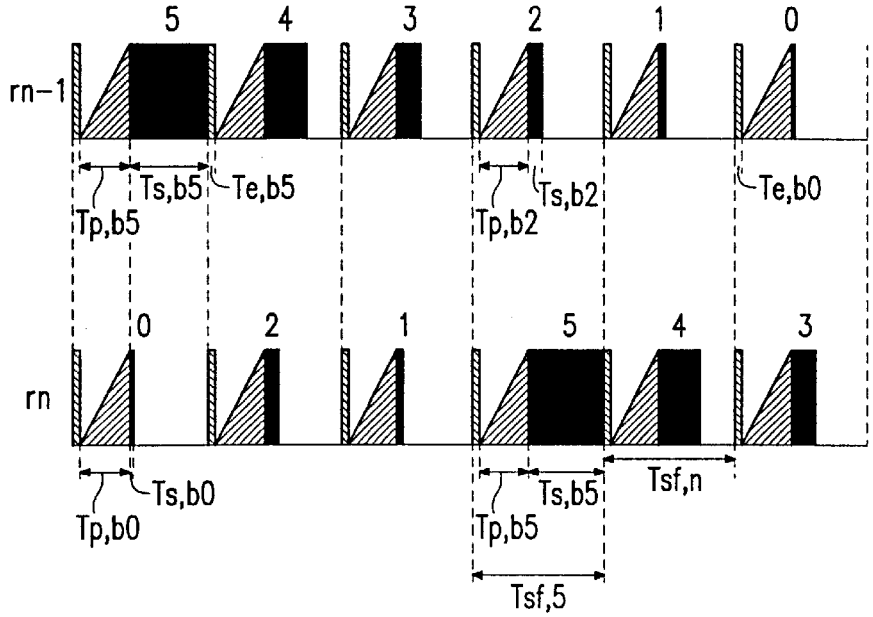
FIG. 6A
FIG. 6B
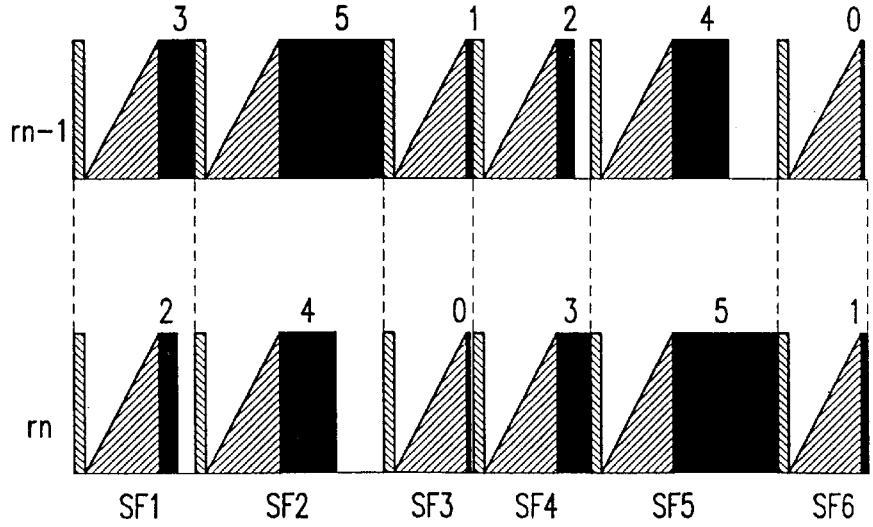
FIG. 7A
FIG. 7B

CIRCUIT FOR AND METHOD OF DRIVING A FLAT PANEL DISPLAY IN A SUB FIELD MODE AND A FLAT PANEL DISPLAY WITH SUCH A CIRCUIT

BACKGROUND OF THE INVENTION

1. Field of the Invention

The invention relates to a circuit for driving a flat panel display in a sub field mode. Information to be displayed is provided as a succession of frames, each to be displayed during a corresponding field period. Such a display includes a plurality of display elements arranged in a matrix of rows and columns, and a plurality of first electrodes, each first electrode of the plurality of first electrodes being associated with display elements in a respective row or column. A circuit of this type includes a timing generator which divides a field period of a received display information into consecutive sub field periods, each sub field period including an address period preceding a display period, and each sub field period having a respective weight factor associated therewith. A drive circuit supplies drive signals, during the sub field periods corresponding to the respective weight factors, to respective addressed electrodes of the plurality of first electrodes. Each display element which is to be lit during a field period is addressed in one or more of the sub field periods, the sum of the weight factors associated with those sub field periods determining the luminance with which the display element is lit.

The invention also relates to a flat panel display apparatus having such a flat panel display and such a circuit for driving the flat panel display, and to a method of driving a flat panel display.

2. Description of Related Art

U.S. Pat. No. 5,541,618 discloses a method and a circuit for gradationally driving a flat panel device such as a Plasma Display Panel (further referred to as PDP). A PDP comprises a plurality of cells formed at cross points of scan electrodes and data electrodes which are arranged orthogonal to the scan electrodes. A picture to be displayed has a frame rate of 60 Hz. Each frame of the picture to be displayed is associated with a field period which is divided into a plurality of sub field periods. Each such field period comprises an address period and a display period. In each address period, the cells to be lit during the subsequent display period are addressed by sequentially selecting the scan electrodes and supplying appropriate data to the data electrodes for each selected scan electrode. In this way a desired charge is stored in the cells to be lit. During each display period sustain pulses are supplied to all the cells to light the cells in which the desired charge is stored. The brightness of a lit cell is determined by the number or the frequency of the sustain pulses. In a preferred embodiment, each display period has a different number of sustain pulses, and the frequency of the sustain pulses is equal for every display period. The number of sustain pulses of the display periods essentially have a ratio of 1:2:4:8: . . . 128. Therefore, the durations of the display periods have also this ratio. The cells or picture elements for the picture to be displayed are each represented by a binary coded data word in which each bit corresponds to one of the sub frames such that the length of the display period of that sub field is in accordance with the weight of the data bit in the data word. The cell is lit during the display period of a certain sub field of the bit of the data word associated with this certain sub field indicates such. So, the bits of the data word determine during which sub frames of a frame the cell produces light. The visual brightness of each cell is determined by the number of sustain pulses accumulated during the entire frame period.

It is a drawback of the method and the circuit for gradationally driving a PDP according to U.S. Pat. No. 5,541,618 that a large area flicker occurs in certain conditions. The large area flicker occurs most noticeably if large areas of cells are lit only during the sub field with the longest display period. A large contribution to the luminance output is generated during a very limited period in time during a frame. These light pulses occur with the repetition frequency of the frame. At a frame repetition frequency of 60 Hz, the eye might integrate the separate light pulses such that a flicker is not very annoying. But, at a frame repetition frequency of 50 Hz the gap in time between the light pulses is so large that the eye clearly detects an annoying flicker. A same reasoning holds if a large area of cells is lit during a sub field with a display period which is not the longest. However, the flicker will be somewhat less as the amount of flicker detected by the eye also depends on the amount of light generated.

BRIEF SUMMARY OF THE INVENTION

It is an object of the invention to provide a drive for a flat panel display such that less flicker occurs.

To this end, a first aspect of the invention provides a circuit for driving a flat panel display having a plurality of first electrodes partitioned into two groups. The first group are driven by signal corresponding to sub field periods in which each of the sub field periods has a weight factor associated with it, and the weight factors for the corresponding sub field periods occur in a predetermined order. The second group is similarly driven by signals corresponding to sub field periods each having a respective weight factor, but the weight factors occur in a different predetermined order. A second aspect of the invention provides a flat panel display apparatus with a flat panel display and a circuit for driving the flat panel display as just described. A third aspect of the invention provides a method of driving such a flat panel display. Advantageous embodiments of the invention are defined in the dependent claims.

An AC plasma display is a bilevel display with a memory function, i.e. it can only turn pixels on or off. To switch a pixel on, a prime sequence (addressing period) is necessary. In such a sequence a pixel that should turn on is conditioned, in such a way, that it turns on when a voltage is put across the scan and sustain electrodes (during the display period). This is done for all pixels in a display that should turn on. The grayscale itself is now generated in such a way that the luminance value is divided into several subfields with various weights. When for a subfield in a display all pixels that should be turned on are primed, the scan and sustain voltage is put on the display for the sustain period corresponding to the weight of that subfield and all primed pixels turn on. In the next subfield this process is repeated for that subfield with the corresponding subfield weight. The weight of a subfield determines how long the pixels are turned on. The luminance value of a pixel is determined by the input byte of Red. Green or Blue (RGB). When the weight of the subfields correspond to the weight of the input bits of a pixel, the weight of a bit corresponding to the subfield weight determines whether this pixel is primed, i.e. whether this pixel is turned on during the sustain period.

When large areas are lit using only one subfield with a high bit weight, in only one moment in time a large contribution to the luminance output is generated. This results in large area flicker with large frequency components of 50 or 60 Hz for which the eye is quite sensitive. The method to be proposed reduces large area flicker behavior when planes of one grayscale are shown, especially when only a few subfields (MSB) generate the luminance in a filed. To overcome the large area flicker in these cases, the odd and even rows are addressed in different groups, and the subfield order of the odd and even rows are chosen differently from each other, so that the odd and even rows are in anti-phase with respect of each other for the subfields with the highest bit weights. This reduces the large area flicker considerable for the frequency components of 50 and 60 Hz. The eye observes both rows at the same time and will mainly see frequency components around 100 or 120 Hz for which the eye is less sensitive.

The above described sub field order is a preferred embodiment of the invention. It is also possible to reduce the flicker if groups of two or more consecutive rows each with a same first sub field order alternate with groups of two or more consecutive rows each with a same second sub field order. It is also possible to repeat a group of rows each having a different sub field proper. For example, a group of four successive rows is repeated, each of the rows out of the group of four has a different sub field order.

Although an optimal reduction of the flicker is obtained if the position of the sub fields with the highest bit weights is selected to be an anti-phase, any different position of these sub fields reduces the flicker.

JP-A-07271325 discloses a circuit for selecting different sub field orders during successive fields. Due to the different position of the sub fields in subsequent fields, the distance in time between corresponding sub fields varies, thereby deteriorating the flicker reduction. As in one field the same sub field order is supplied to every scan electrode, the scan electrodes need not be connected in groups, and the data bit order need not be changed within a field.

The publication 19.4 "Improvement in PDP Picture quality by Three-Dimensional Scattering of Dynamic False contours", by T. Yamaguchi et. al., SID 96 DIGEST, pages 291–294 discloses that disturbances of the grey level called dynamic false contours are reduced by splitting the two most significant sub fields into four sub fields with an equal length D. The length of the remaining sub fields is denoted by A. This publication does not refer to flicker improvement. The splitting of two sub fields into four sub fields has the disadvantage that two more address periods are needed. So, this method requires a 1.25 times faster switching operation of the discharge cells, or in practice, the total time for generating light and thus the light output decreases with 25%. This SID publication is concerned with signal processing which decodes the binary coded data words into drive signals which randomly select the right sub field in successive frames to obtain the light output corresponding to the data word. In this way, the light pulse occurrence is randomised in moment of occurrence. It is disclosed that a certain data value can be generated by the sub fields belonging to A, or by selecting one of the four sub fields D. It is further disclosed that from horizontal line to line in subsequent fields the order of the four sub fields D and the sub field A may be changed. There is no disclosure of any hardware measure enabling a different sub field order for different lines within one and the same field.

So, this publication discloses that the visibility of dynamic false contours is minimized by selecting a different sub field order in successive field periods. This is not an effective measure to reduce flicker. According to the invention, different sub field orders are applied to different groups of rows in a same field period thereby reducing the flicker. It has to be noticed that it is additionally possible to select different sub field orders in successive field periods for one or each of the groups of rows. In this way, the invention provides a solution to decrease the amount of flicker as well the visibility of the false contours.

In one embodiment of the invention, a display element is formed by the crossing of a scan electrode and a data electrode. In the prior art, this type of display is referred to as opposed-discharge type.

In another embodiment of the invention, a plasma panel sub-pixel (also referred to as cell or display element) is formed by the crossing of two row electrodes and a column electrode. The two row electrodes extend in the row direction. They are referred to as scan electrodes and sustain electrodes. Plasma channels may be aligned with the row or the column electrodes. Plasma cells may be used instead of plasma channels. In the prior art, this type of display is referred to as surface-discharge type.

In a preferred embodiment of the invention, the flicker is reduced by a large amount because the different sub field orders occur in consecutive lines and thus are optionally integrated by the eye.

In an embodiment according to another preferred aspect of the invention, the flicker is reduced by a large amount because sub fields which have a same bit weight are applied to one of the groups of the scan electrodes shifted over about a half field period in time with respect to the other group of scan electrodes. As a result, the eye sees the light pulses associated with these sub fields with double field frequency.

In yet another embodiment the scan driver is configured such that the address periods of the first electrodes coincide in time. This has the advantage that common circuitry can be used to address the whole PDP for every sub field, independent of the length of the display period of a sub field.

In an embodiment which has the same advantage, the timing circuit supplies an order of weight factors for the sub field periods of the two groups such that the weight factors of display periods of corresponding sub field periods differ minimally. Further, let us assume that the sub field order of two consecutive rows is different. This implies that after the common addressing period of a certain sub field in the field, the duration of the subsequent display period differs for the two rows. To be able to again have a common addressing period for the next sub field, an idle period occurs for the row with the shortest display period. This lost idle time is minimal if the duration of the display periods corresponding to a same addressing period differ minimally. This is the case if the weights associated with the corresponding display periods differ minimally.

In an embodiment of the invention when the received display information comprises data words having binary coded bits corresponding to weights, the timing generator generates weight factors of the display periods within a field period such that each weight factor corresponds to the weight factor for one of the bits, and the weight of the sub fields corresponds to the weight value for each of the bits of the data word, such that a minimal number of sub fields are required.

These and other aspects of the invention will be apparent from and elucidated with reference to the accompanying drawings.

BRIEF DESCRIPTION OF THE DRAWINGS

In the drawings:

FIGS. 6A and 6B show a schematic representation of the address periods and the display periods of the sub fields of rows with a different sub field order, whereby the address periods coincident and the sub field period has a fixed duration, FIGS. 7A and 7B show a schematic representation of the address periods and the display periods of the sub fields of rows with a different sub field order, whereby the address periods coincident and the sub field periods differ.

DETAILED DESCRIPTION OF THE INVENTION

Figure 1:
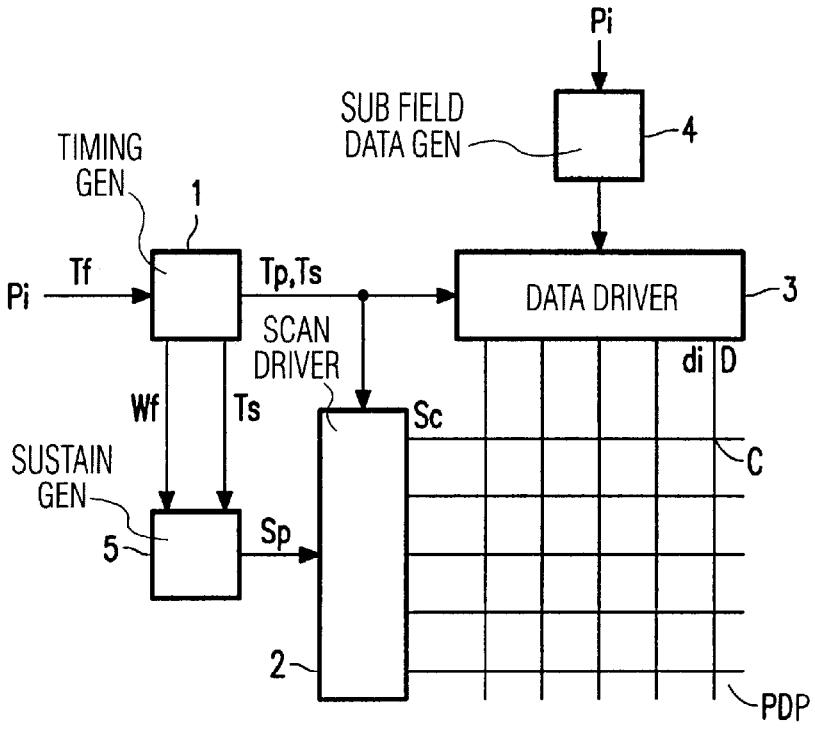
FIG. 1 PRIOR ART
FIG. 1 schematically illustrates a circuit for driving a PDP of a opposed-discharge type in a sub field mode as known from the prior art, FIG. 2 schematically illustrates a circuit for driving a PDP of a surface-discharge type in a sub field mode as known from the prior art, FIG. 3 schematically illustrates a basic sub-pixel structure of a surface-discharge type PDP.

FIG. 1 schematically illustrates a circuit for driving a PDP of a opposed-discharge type in a sub field mode as known from the prior art. Two glass panels (not shown) are arranged opposite to each other. Data electrodes D are arranged on one of the glass panels. Scan electrodes Sc are arranged on the other glass panel such that the scan electrodes Sc and the data electrodes D are perpendicular. Display elements (for example plasma cells) C are formed at the cross points of the data electrodes D and the scan electrodes Sc. A timing generator 1 receives display information Pi to be displayed on the PDP. The timing generator 1 divides a field period Tf of the display information Pi into a predetermined number of consecutive sub field periods Tsf (see FIG. 4). A sub field period Tsf comprises an address period Tp and a display period Ts. During an address period Tp, a scan driver 2 supplies pulses to the scan electrodes Sc for successively selecting the scan electrodes one by one, and a data driver 3 supplies data di to the data electrodes D to write the data di to the display elements C associated with the selected scan electrodes Sc. In this way the display elements C associated with the selected scan electrode Sc are preconditioned. During a display period Ts, a sustain generator 5 generates sustain pulses Sp which are supplied to the display elements C via the scan driver 2. It is also possible to supply the sustain pulses Sp to the data driver 3 or both to the scan driver 2 and the data driver 3. The display elements C which are preconditioned during the address period Tp to produce light during the display period Ts will produce an amount of light depending on a number or a frequency of the sustain pulses Sp.

The timing generator 1 further associates a fixed order of weight factors Wf to the sub field periods Sf in every field period Tf. The sustain pulse generator 5 is coupled to the timing generator 1 to supply a number or a frequency of the sustain pluses Sp in conformance with the weight factors Wf such that an amount of light generated by a preconditioned display element C corresponds to the weight factor Wf. A sub field data generator 4 performs an operation on the display information Pi such that the data di is in conformance with the weight factors Wf.

Such a PDP and the operation thereof in a sub field mode are described in detail in U.S. Pat. No. 5,541,618 which is hereby incorporated by reference.

Figure 2:
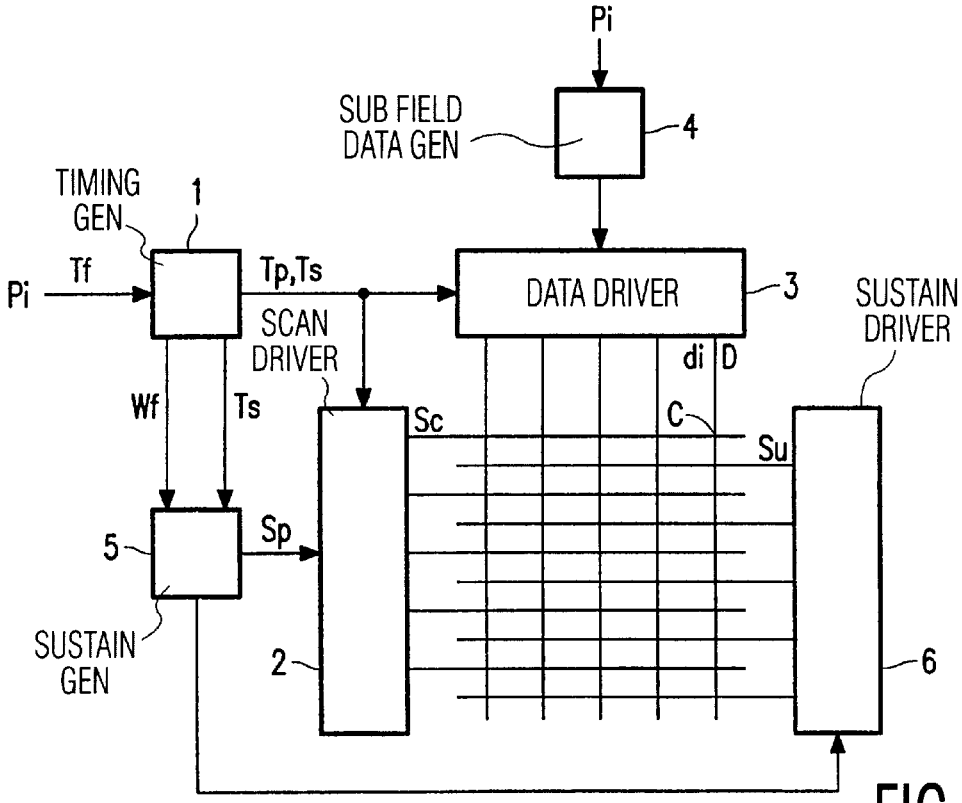
FIG. 2 PRIOR ART

FIG. 2 schematically illustrates a drive circuit for driving a PDP of a surface-discharge type in a sub field mode as known from the prior art. The surface-discharge PDP differs from the opposed-discharge PDP in that an extra scan electrode Su (referred to as sustain electrode) is arranged in parallel with each scan electrode Sc. The circuit of FIG. 2 differs from the circuit shown in FIG. 1 in that a sustain driver 6 is added to drive the sustain electrodes Su. The sustain pulse generator 5 also supplies the sustain pulses Sp to the sustain driver 6. Same elements in FIG. 2 and FIG. 1 are indicated by the same references. During the address period Tp, the scan driver selects the scan electrodes Sc one by one. The data driver 3 supplies for each selected electrode Sc the data di to precondition the display elements C associated with the selected scan electrodes Sc. During the display period Ts, the sustain driver 6 together with the scan drier 2 generates sustain pulses Sp between the sustain electrodes Su and the scan electrodes Sc. The picture elements C which are preconditioned to produce light will do so. It is also possible to supply the sustain pulses Sp to either the scan driver 2 or the sustain driver 6.

Such a PDP and the operation thereof in a sub field mode are described in detail in U.S. Pat. No. 5,541,618 or in EP-B-0,549,275.

Figure 3:
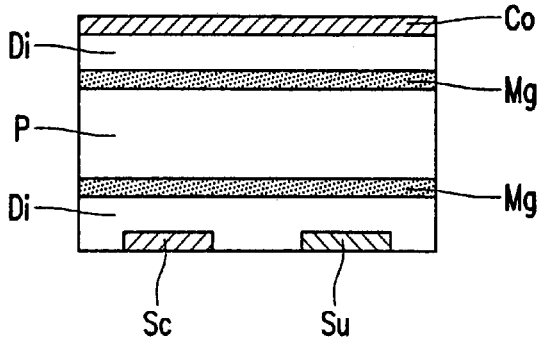
FIG. 3 PRIOR ART

FIG. 3 schematically illustrates a basic AC plasma sub-pixel of the surface-discharge type PDP. The plasma sub-pixel or display element C is formed by the crossing of two row electrodes Sc, Su and a column electrode Co. The two row electrodes Sc, Su are situated at the bottom of the sub-pixel and are referred to as scan electrode Sc and sustain electrodes Su. The column electrode Co is situated on top of the sub pixel and is referred to as data electrode D. Plasma P is arranged between the column electrode Co and the two row electrodes Sc, Su via respective dielectric layers Di. The plasma P is insulated from the dielectric layers Di by MgO layers Mg. When regarding a complete panel, the sustain electrodes Su are interconnected for all rows of the PDP panel. The scan electrodes Sc are connected to row IC's and scanned during the addressing or priming phase. The column electrodes Co are operated by column IC's. The plasma cells C are operated in three modes:

1) The Erase mode. Before each sub-field is primed, all plasma cells C are erased together at the same time. This is done by first driving the plasma cells C into a conducting state and then removing all charge built up in the cells C.

2) Prime mode. Plasma cells C are conditioned such that they will be in an on or off state during sustain mode. Since a plasma cell C can only be fully on or off, several prime phases are required to write all bits of a luminance value. Plasma cells C are selected on a row-at-a-time basis and the voltage levels on the columns Co will determined the on/off condition of the cells. If a luminance value is represented in 6 bits, then also 6 subfields are defined within a field.

3) Sustain mode. An alternating voltage is applied to scan and sustain electrodes Sc, Su of all rows together at the same time. The column voltage is mainly at a high voltage potential. The plasma cells C primed to be in the on state, will light up. The weight of an individual luminance bit will determine the number of light pulses during sustain. When the power dissipation of the panel is too high, the number of sustain pulses in each subfield is shortened to the same extent (so less sustain pulses are actually generated) thereby reducing the panel's light output and power dissipation.

Figure 4:
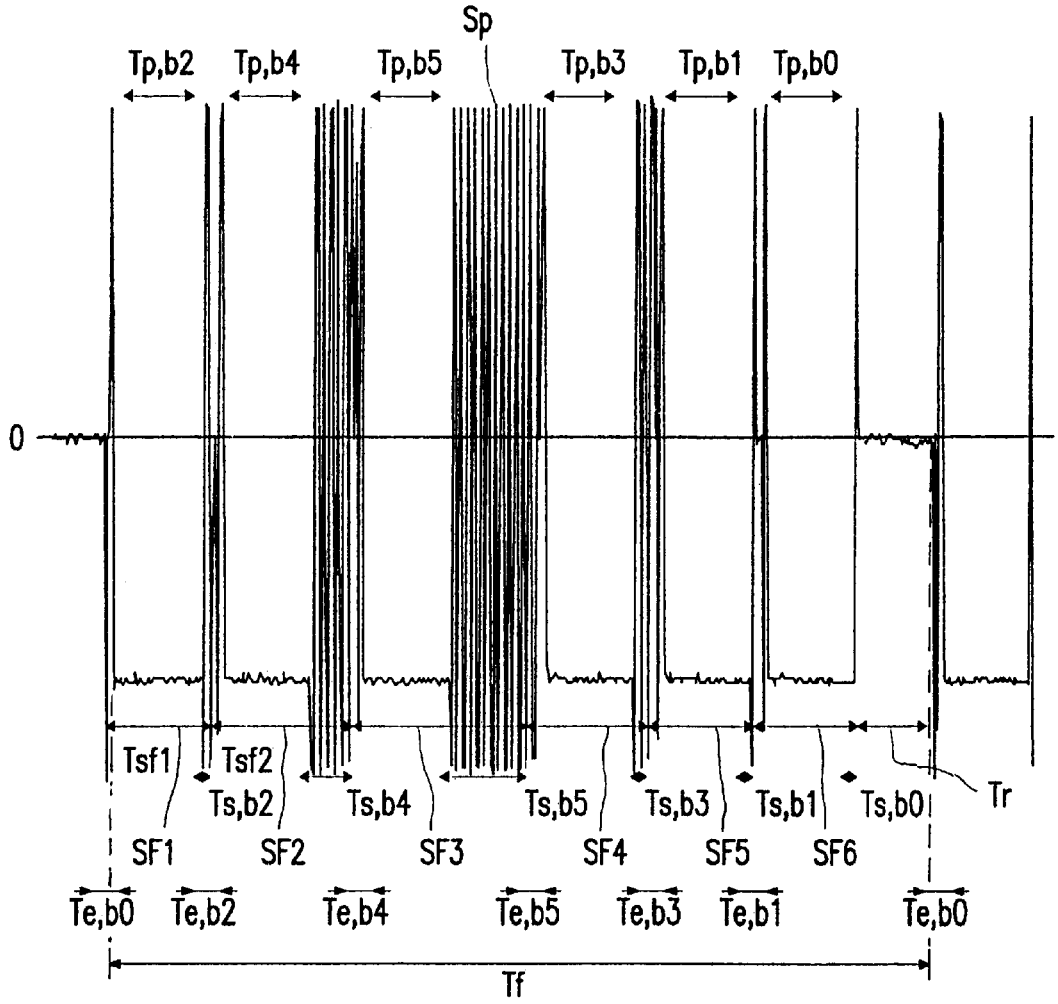
FIG. 4 PRIOR ART
FIG. 4 shows voltage waveforms between a scan electrode and a sustain electrode of the prior art surface-discharge type PDP.

FIG. 4 shows voltage waveforms between scan electrodes Sc and sustain electrodes Su of the known surface-discharge type PDP. Since there are three modes, the corresponding time sequence is indicated as Te,bx (erase mode for bit-x subfield SFi), Tp,bx (prime mode for bit-x subfield SFi) and Tx,bx (sustain mode for bit-x subfield SFi). The number of sustain pulses will vary in time to limit the power dissipation so a residual time Tr is taken into account to match the field frequency again. FIG. 4 shows the result of a measurement of the differential voltage between a scan and the common sustain electrodes Sc, Su when this voltage is measured over a field.

FIG. 4 only gives a rough indication of what happens in a field period Tf. Prime and erase sequences in each subfield SFi are the same. The duration of the sustain sequence Ts,bx depends on the weight of the individual bits and contains a number of alternating pulses with the same frequency. When the power dissipation of the panel is too high, the number of alternating pulses during sustain time Ts,bx will be less. This results in shorter sustain periods Ts,bx in the subfields SFi and the residual time Tr will increase to match the field frequency.

Table 1 Timing in erase, prime and sustain modes.

TABLE 1

Timing in erase, prime and sustain modes.

| | bit-5 (μs) | bit-4 (μs) | bit-3 (μs) | bit-2 (μs) | bit-1 (μs) | bit-0 (μs) |
|---|---|---|---|---|---|---|
| Tp.black | | | 6 × 1800 | | | |
| Ts.black | 1737 (179c) | 854 (87c) | 432 (43c) | 221 (21c) | 115 (10c) | 57 (4c) |
| Te.black | | | 6 × 168 | | | |
| Tr.black | | | 1 × 1443 | | | |
| Tp.white | | | 6 × 1800 | | | |
| Ts.white | 1017 (104c) | 499 (50c) | 259 (25c) | 125 (11c) | 67 (5c) | 38 (2c) |
| Te.white | | | 6 × 168 | | | |
| Tr.white | | | 1 × 2854 | | | |

Table 1 gives an overview of the panel's timing when an over-all black (level 0) or white (level 63) picture is displayed. As can be seen from the table, the prime and erase modes are not changed when the power dissipation is limited by the electronics. The number of sustain pulses is roughly halved when a complete white picture is displayed. The number of sustain pulses is also given in the table (pulse count can be formed between brackets in the Ts-rows). Equation 1 can be used to calculate the sustain time Ts,bx in a subfield SFi.

$$Ts,bx=T_{sustain}=19-9.6.\ N\ (\mu s) \qquad \text{Equation 1}$$

The variable N stands for pulse count, printed in the table. Each pulse takes 9.6 μs and N pulses are always preceded by a specified sequence of 19 μs.

Figure 5A:
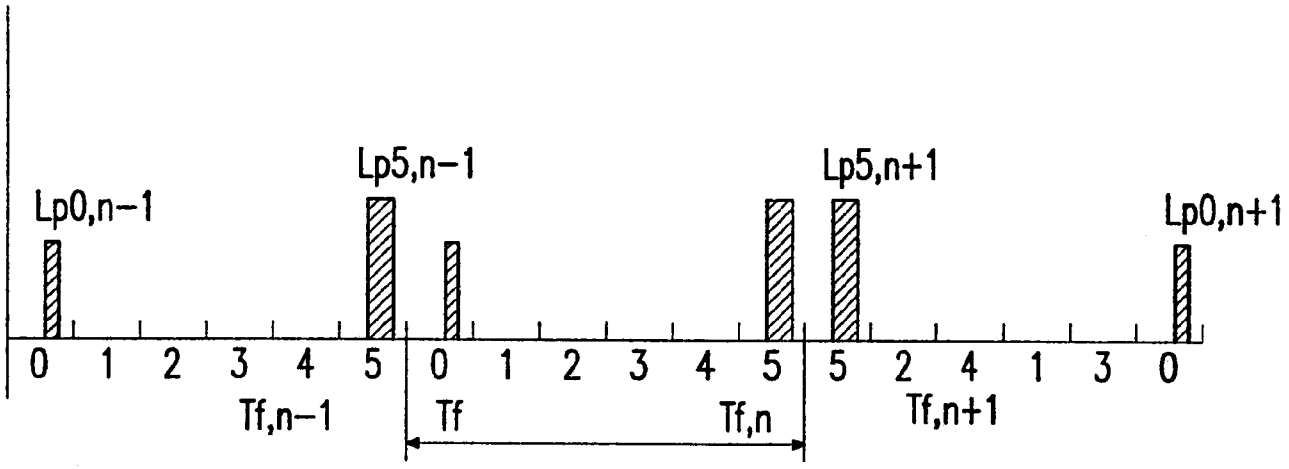
FIG. 5A PRIOR ART
FIGS. 5A and 5B show the moments of occurrence of the light pulses in subsequent fields if the least and the most significant bit are on, in FIG. 5A the sub field order is changed in subsequent fields according to the prior art, in FIG. 5B the sub field order is changed in subsequent rows according to an embodiment of the invention.
Figure 5B:
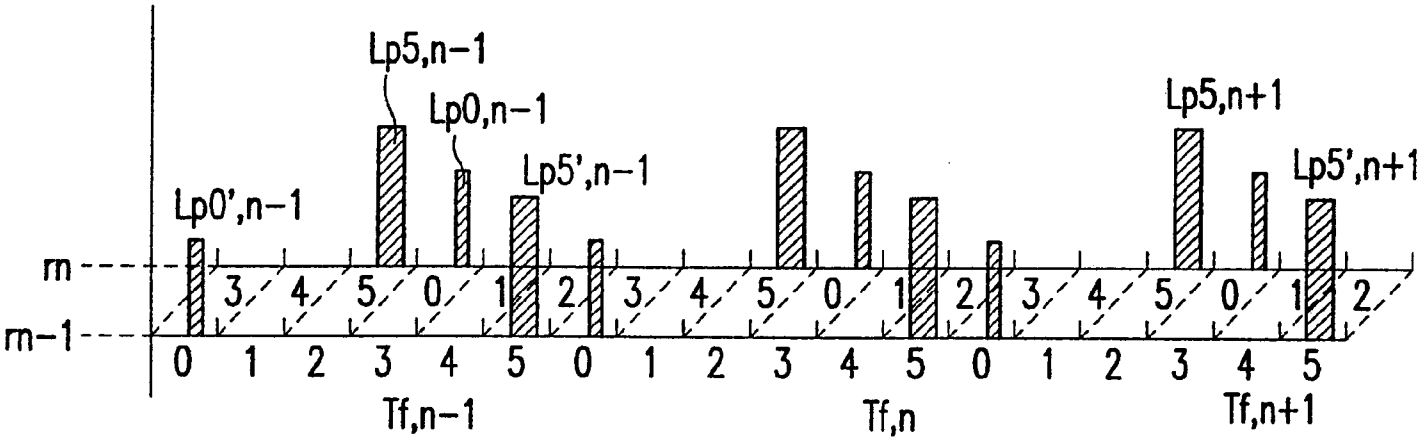

FIGS. 5A and 5B show the moments of occurrence of light pulses Lpi,n in subsequent field periods Tf,n if the least and the most significant bit are on. In both FIG. 5A and FIG. 5B, three subsequent field periods are denoted with Tf,n−1, Tf,n, and Tf,n+1. In the following, the three fields corresponding to these field periods are referred to as fields n−1, n, and n+1.In each of the fields n−1, n, n+1, the sub field periods Tsf,bi are referred to by the numerals 0 to 5. These numerals indicate the bit weight of the sub fields Sfi: The least significant bit is associated with sub field 0, the most significant bit is associated with sub field 5. Only the least and the most significant bits are on. The light generated during the display period Ts associated with the least significant bit is indicated by a small bar, the light generated during the display period Ts associated with the most significant bit is indicated by a large bar. In FIG. 5A the sub field order is changed in subsequent fields n according to the prior art. In FIG. 5B the sub field order is changed in subsequent rows rn according to an embodiment of the invention.

In FIG. 5A, field n+1has another sub field order than fields n−1 and n. Flicker will be reduced between the fields n and n+1 as the time gap between the moments of occurrence of the sub fields 5 of the most significant bits is shorter than a field period Tf. However the time gap between the sub fields 5 of the most significant bits in the fields n−1 and n is still a field period Tf. This gives rise to flicker. In the prior art approach it is not possible to select a sub field order in successive fields n whereby the time gap between the moments of occurrence of the sub field 5 in successive fields n is always less than a field period Tf. So, still flicker occurs.

In FIG. 5B, the sub field order in two consecutive rows rn and rn−1 is shown, each for 3 consecutive fields n−1, n, n+1. The sub field order of the rows rn and rn−1 is selected different such that the sub field 5 of the most significant bit occurs at different instants within each of the fields n−1, n, n+1. As the rows rn and rn−1 are spatially close to each other, the eye detects a double repetition frequency of the light pulses associated with the most significant bits. The flicker is reduced drastically.

FIGS. 6A and 6B show a schematic representation of the address periods Tp,bx and the display periods Ts,bx of the sub fields 0 to 5 of rows rn−1 and rn with a different sub field order, whereby the address periods Tp,bx are coincident and all sub field periods Tsf,n have a fixed duration. Both FIGS. 6A and 6B show the sub field order during a same field for two consecutive rows rn−1 and rn. The erase periods Te,bx are shown as small shaded bars, the address or prime periods Tp,bx are represented by the triangle shaped shaded areas, and the display or sustain periods Ts,bx are shown as black areas.

Numerous possibilities exists for the various subfield orders for the odd and even rows rn−1 and rn. It is advantageous if the addressing (prime) and erase period are Tp,bx; Te,bx are common for the entire display. The duration of the sustain period Ts,bx is determined by the weight of the specific subfield κ. The weight of a subfield κ determines the number of sustain pulses SP that are given for that sustain period Ts,bx. This is important to notice since it, therefore, means that time is lost when the sustain period Ts,bx of the odd rows rn−1 is shorter than for the even rows rn or vice versa. In the case that the sustain period Ts,bx is over the odd or even rows rn−1, rn, no sustain pulses are given for the specific odd or even rows rn−1, rn.

In this analysis the following is assumed:

The addressing (prime) period Tp,bx and the erase period Te,bx are done in the conventional manner, i.e. for the entire display. A sustain period Ts,bx can only start after an erase and addressing period Tp,bx; Te,bx has been completed.

Six, seven or eight subfields Ts,bx are assumed with their own bit weight.

As long as the sustain period Ts,bx for either the even rows or the odd rows rn, rn−1 is not finished, no activity can take place. The sustain cycles for either the odd or even rows rn−1, rn stops, until the sustain period Ts,bx for both are over. Time is therefore wasted.

For optimum flicker reduction, the start of the sustain period Ts,bx of a subfield κ with a specific weight of the odd rows rn−1 should be positioned with a half row offset compared to the even rows r,n (or vice versa). This means that when we have a field rate of 50 Hz, subfield 1 for the even row rn is delayed with 10 ms compared to the odd row rn−1. When this condition is met the flicker frequency is doubled from 50/60 to 100/120 Hz and this frequency is not visible for the eye. When this condition is not met, a non optional flicker reduction can be expected. As long as the lowest flicker component is higher than about 80 Hz, it is still above the flicker fusion frequency (the frequency which makes flicker just noticeable). 80 Hz results in a time period of 12.5 ms. It is attempted to reduce the flicker for all subfield weights, thus the 12.5 ms distance is required for all subfield weights. It is questionable whether this is necessary for the lowest subfield weights. This must be found out be experimenting. It is also attempted to reduce the flicker for an object which changes slightly in luminance. Suppose an object has a luminance of bit weight 7 (128) and changes to 127. It is now also attempted that the time gap between switching on the new highest bit weight (bit 6) of that object and the former highest bit weight (b7) is smaller than 12.5 ms, but also that the highest subfield has a time gap between two sustain periods of the same bit weight smaller then 12.5 ms. This time gap also take place in two successive frames Tf. This object must be at least larger than the height of two rows rn.

When this is not the case the change in subfield order between two rows rn, rn−1 does not result in a reduction of the large area flicker, but probably the flicker is not noticeable since the area is too small.

One solution for distributing the sub fields 0 to 5 with the various weights for the odd and even rows rn−1, rn is to reserve the most significant bit (MSB) sub field length Tf,5 for all sub fields 0 to 5. This implies that any desired sub field order can be implemented. It is possible to reach the optimum flicker frequency of 100 or 120 Hz for all bit weights. A disadvantage is that in all sub fields x other than that with the highest weight a lot of time is wasted. Consequently, the maximum number of sustain pulses in each sustain period Ts,bx is reduced and therefore the peak white level becomes lower.

Another solution for distributing the sub fields x over the odd and even rows rn−1, rn is shown in FIGS. 7A and 7B.

FIGS. 7A and 7B show a schematic representation of the address periods Tp,bx and the display periods Ts,bx of the sub fields 0 to 5 of two rows rn−1, rn with a different sub field order, whereby the addressing periods Tp,bx are coincident and the duration of sub field periods Tsf,n in one row rn differs. A next sub field SFx is started after the sustain period Ts,bx with the longest duration in the preceding sub field SFx-1. So, in two consecutive rows rn−1, rn, two corresponding sub fields SFx have a same duration which is determined by the sub field SFx with the longest duration. In FIG. 7B the corresponding sustain periods Ts,bx in the odd and even rows rn−1, rn differ minimally in weight (the MSB corresponds to the MSB−1, and so on). In this situation a minimal amount of time is wasted.

Figure 8:
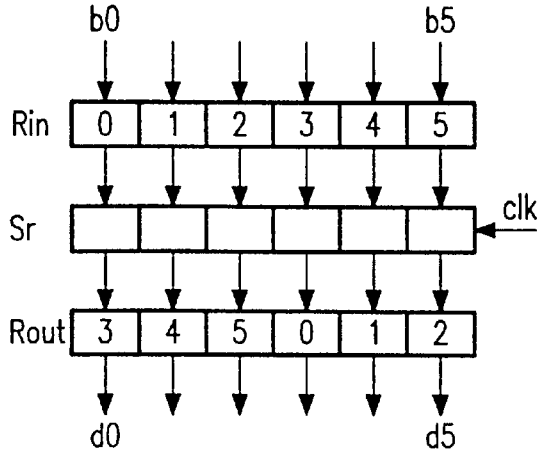
FIG. 8 shows a block diagram of a circuit for implementing the sub field bit shifts.

FIG. 8 shows a block diagram of a circuit for implementing the sub field bit shifts. This is a possible implementation of the sub field SFx order change by only three bit shifts. It is implemented from a parallel-in to a parallel out method. This is only one implementation, other implementations are possible. An input register Rin stores the six data bits bi of a data word of the received display information Pi. The data bits bi in the input register Rin are transferred to a shift register Sr. Every row rn, the shift register Sr is clocked three times to shift the data bits bi over three positions. The shifted data bits bi are transferred to an output register Rout to be used during one row rn.

Figure 9:
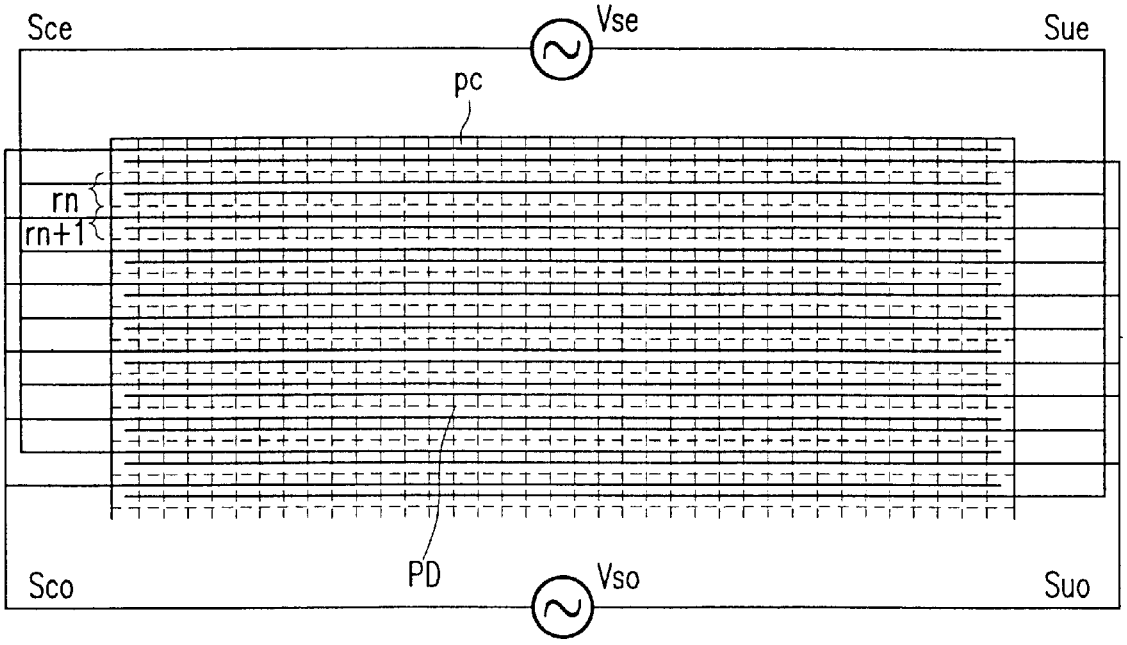
FIG. 9 shows the interconnection of the scan electrodes and the sustain electrodes enabling a different sub field order for even and odd rows according an embodiment of the invention.

FIG. 9 shows the interconnection of the scan electrodes Sce, Sco and the sustain electrodes Sue, Suo enabling a different sub field order for even and odd rows rn, rn−1 according an embodiment of the invention.

In the plasma display PDP both the scan and sustain electrodes Sc,Su are divided into two groups with the odd scan and sustain electrodes Sco,Suo into one group and the even scan and sustain electrodes Sce, Sue in the other group.

In the prime mode, the entire screen PD is primed with the odd rows rn−1 primed for a subfield SFΘ with a bit weight of subfield order Θ, and the even rows rn are primed for a subfield SFΘ with a bit weight of subfield order y. The subfield order Θ and y may only differ by three bit shifts. In the sustain mode the two groups of rows rn, rn−1 are sustained according to the weight of the subfield SFΘ where they were primed for. Subfield order Θ gives for example a sustain pulses whereas subfield order y results in b sustain pulses. When for example the subfield order for the current field is Θ for the odd rows rn−1 and y for the even rows rn, and the number of sustain pulses at each bit weight is according to Table 2.

TABLE 2

| bit weight | 0 | 1 | 2 | 3 | 4 | 5 |
|---|---|---|---|---|---|---|
| nr. of sustain pulses | 4 | 10 | 21 | 43 | 87 | 179 |
| subfield order x | 3 | 4 | 5 | 0 | 1 | 2 |
| nr. of sustain pulses | 43 | 87 | 179 | 4 | 10 | 21 |
| subfield order y | 0 | 1 | 2 | 3 | 4 | 5 |
| nr. of sustain pulses | 4 | 10 | 21 | 21 | 87 | 179 |

The number of sustain pulses in the first subfield SF1 is 43 for the odd rows rn−1 and 4 for the even rows rn. In the next subfield SF2, the odd rows rn−1 generates 87 sustain pulses whereas the even rows rn generates 10 sustain pulses and so on.

The sustain pulses Sp for the even rows rn are supplied by a voltage source Vse arranged between a first group of interconnected even scan electrodes Sce on the one hand and a first group of interconnected associated even sustain electrodes Sue on the other hand. The sustain pulses Sp for the odd rows rn−1 are supplied by a voltage source Vso arranged between a second group of interconnected odd scan electrodes Sce on the one hand and a second group of interconnected associated odd sustain electrodes Sue on the other hand. It is also possible to supply each of the groups of scan electrodes Sce, Sco and sustain electrodes Sue, Suo with a separate voltage. As discussed before, the prime phase and erase phase are performed in common for all rows in a well known matter. The sustaining during a series of sub fields Sfi for all rows is well known in the art.

While the invention has been described in connection with preferred embodiments, it will be understood that modifications thereof within the principles outlined above will be evident to those skilled in the art and thus the invention is not limited to the preferred embodiments but is intended to encompass such modification. The amount of light produced during a sustain period may also be adapted by controlling the amplitude of the sustain pulses.

What is claimed is:

1. A circuit for driving a flat panel display comprising a plurality of display elements arranged in a matrix of rows and columns, and a plurality of first electrodes, each first electrode of the plurality of first electrodes being associated with display elements in a respective row or column, wherein said circuit drives said display in a sub field mode, and the circuit comprises:

a timing generator configured to:

divide a field period of a received display information into consecutive sub field periods, each sub field period including an address period preceding a display period, and each sub field period having a respective weight factor associated therewith, at least some of said weight factors differing from others of said weight factors, and generate an order in which the sub field periods having the respective weight factors occur during a field period, and a drive circuit configured to supply drive signals, during respective sub field periods corresponding to the respective weight factors, to respective addressed electrodes of said plurality of first electrodes, wherein for each respective display element, a combination of the weight factors for the sub field periods in which the respective display element is addressed during a given field period corresponds to a respective display element luminance value for the given field period, characterized in that the plurality of first electrodes is partitioned into at least first and second groups, the drive circuit supplies said drive signals to said at least first and second groups, and the timing generator generates a first order of sub field occurrence applied to the first group, and a second order of sub field occurrence different from said first order applied to the second group, whereby the order in which drive signals of respective weight factors are applied to the first group is different from the order in which the drive signals of the same weight factors are applied to the second group.

2. A circuit as claimed in claim 1, characterized in that the respective weight factors for the subfields, supplied to one of said groups during a same field, are respectively different.

3. A circuit as claimed in claim 1, characterized in that the first electrodes are connected in groups such that adjacent electrodes of said plurality of first electrodes belong to different groups.

4. A circuit as claimed in claim 1, characterized in that the timing generator supplies an order of weight factors of said at least first and second groups such that a difference in time between sub field periods having equal weight factors is equal for adjacent first electrodes of said plurality of first electrodes.

5. A circuit as claimed in claim 1, characterized in that the received display information comprises data words having bits with binary coded weights, and the timing generator is configured to generate the weight factors of the display periods within each field period such that each weight factor corresponds with one of the bits.

6. A circuit as claimed in claim 1, characterized in that the flat panel display further comprises second electrodes arranged orthogonal with respect to the plurality of first electrodes, each display element being coupled to a respective one of the first electrodes and a respective one of the second electrodes, and the drive circuit further comprises:

a scan driver for successively selecting at least part of the plurality of first electrodes during the address period, a data driver for supplying data to the second electrodes to selectively precondition display elements corresponding to a selected first electrode of the plurality of first electrodes, a sub field data generator coupled to receive the display information for generating the data in conformance with the order of the weight factors, sustain pulse generator for generating, during the display period, sustain pulses being supplied to the display elements via the scan driver or the data driver for activating the selectively preconditioned display elements to produce a predetermined amount of light corresponding to the weight factor associated with the display period, and the scan driver or data driver are configured to supply to each of said at least first and second groups corresponding sustain pulses.

7. A circuit as claimed in claim 6, characterized in that the scan driver is configured such that the address periods of the first electrodes coincide in time.

8. A circuit as claimed in claim 7, characterized in that the timing generator supplies an order or weight factors for the sub field periods of said two groups such that the two weight factors of display periods of corresponding sub field periods differ minimally in time.

9. A circuit as claimed in claim 1, characterized in that:

the flat panel display further comprises:

second electrodes arranged orthogonal with respect to the plurality of first electrodes, and third electrodes respectively aligned with said first electrodes to form pairs, the display elements being arranged at intersections of the second electrodes with said pairs, and the drive circuit further comprises:

a scan driver for successively selecting at least part of the plurality of first electrodes during the address period, a data driver for supplying data to the second electrodes to selectively precondition the display elements corresponding to a selected first electrode of the plurality of first electrodes, a sub field data generator coupled to receive the display information for generating the data in conformance with the order of the weight factors, a sustain driver for supplying pulses to the third electrodes, and a sustain pulse generator that is configured to generate, during the display period, sustain pulses that are supplied to the display elements via the scan driver and/or the sustain driver for activating the selectively preconditions display elements to produce a predetermined amount of light corresponding to the weight factor associated with the display period, and the scan driver and/or sustain driver are configured to supply to each of said at least first and second groups corresponding sustain pulses.

10. A circuit as claimed in claim 9, characterized in that first electrodes associated with adjacent pairs belong to different groups, and in that the third electrodes associated with adjacent pairs belong to different groups.

11. A circuit as claimed in claim 9, characterized in that the scan driver is configured such that the address periods of the first electrodes coincide in time.

12. A circuit as claimed in claim 11, characterized in that the timing generator supplies an order or weight factors for the sub field periods of said two groups such that the weight factors of display periods of corresponding sub field periods differ minimally in time.

13. A display apparatus comprising:

a flat panel display comprising a plurality of display elements arranged in a matrix of rows and columns, and a plurality of first electrodes, each first electrode of the plurality of first electrodes being associated with display elements in a respective row or column, and a circuit for driving said display in a sub field mode, comprising:

a timing generator configured to:

divide a field period of a received display information into consecutive sub field periods, each sub field period including an address period preceding a display period, and each sub field period having a respective weight factor associated therewith, at least some of said weight factors differing from other of said weight factors, and generate an order in which the sub field periods having the respective weight factors occur during a field period, and a drive circuit configured to supply drive signals, corresponding to the respective weight factors during respective sub field periods, to respective addressed electrodes of said plurality of first electrodes, wherein for each respective display element, a combination of the weight factors for the sub field periods in which the respective display element is addressed during a given field period corresponds to a respective display element luminance value for the given field period, characterized in that the plurality of first electrodes is partitioned into at least first and second groups, the drive circuit supplies said drive signals to said at least first and second groups, and the timing generator generates a first order of sub field occurrence applied to the first group, and a second order of sub field occurrence different from said first order applied to the second group, whereby the order in which drive signals of respective weight factors are applied to the first group is different from the order in which drive signals of the same weight factors are applied to the second group.

14. A display apparatus as claimed in claim 13, characterized in that the first electrodes are connected in groups such that adjacent electrodes of said plurality of first electrodes belong to different groups.

15. A display apparatus as claimed in claim 13, characterized in that the flat panel display further comprises second electrodes arranged orthogonal with respect to the plurality of first electrodes, each display element being coupled to a respective one of the first electrodes and a respective one of the second electrodes, and the drive circuit further comprises:

a scan driver for successively selecting at least part of the plurality of first electrodes during the address period, arranged such that the address periods of the first electrodes coincide in time, a data driver for supplying data to the second electrodes to selectively precondition display elements corresponding to a selected first electrode of the plurality of first electrodes, a sub field data generator coupled to receive the display information for generating the data in conformance with the order of the weight factors, a sustain pulse generator for generating, during the display period, sustain pulse being supplied to the display elements via the scan driver or the data driver for activating the selectively preconditioned display elements to produce a predetermined amount of light corresponding to the weight factor associated with the display period, and the scan driver or data driver are configured to supply to each of said at least first and second groups corresponding sustain pulses.

16. A display apparatus as claimed in claim 13, characterized in that:

the flat panel display further comprises:

second electrodes arranged orthogonal with respect to the plurality of first electrodes, and third electrodes respectively aligned with said first electrodes to form pairs, the display elements being arranged at intersections of the second electrodes with said pairs, and the drive circuit further comprises:

a scan driver for successively selecting at least part of the plurality of first electrodes during the address period, arranged such that the address periods of the first electrodes coincide in time, a data driver for supplying data to the second electrodes to selectively precondition the display elements corresponding to a selected first electrode of the plurality of first electrodes, a sub field data generator coupled to receive the display information for generating the data in conformance with the order of the weight factors, a sustain driver for supplying pulses to the third electrodes, and a sustain pulse generator that is configured to generate, during the display period, sustain pulses that are supplied to the display elements via the scan driver and/or the sustain driver for activating the selectively preconditioned display elements to produce a predetermined amount of light corresponding to the weight factor associated with the display period, and the scan driver and/or sustain driver are configured to supply to each of said at least first and second groups corresponding sustain pulses.

17. A method of driving a flat panel display to display received information for successive fields in a sub field mode, said display comprising a plurality of display elements arranged in a matrix of rows and columns, and a plurality of first electrodes associated with respective display elements in a row or column, wherein the method comprises:

dividing a field period of said received information into consecutive sub field periods each having a respective address period preceding a respective display period, associating a respective weight factor with each respective sub field period, at least some of said weight factors differing from others of said weight factors, generating a predetermined order in which the sub field periods occur during said field period, and during each display period, supplying to respective addressed first electrodes drive signals corresponding to the weight factors for the respective sub field period, characterized in that the plurality of first electrodes is partitioned into at least two groups, said supplying drive signals includes, in a same field period, supplying drive signals to one of said groups during different sub field periods from the sub field periods in which drive signals are supplied to the other of said groups, and said generating a predetermined order includes, within the same field period, associating one predetermined order of the weight factors for the respective sub field periods in which drive signals are supplied to said one of said groups, and a different predetermined order of the weight factors for the respective sub field periods in which drive signals are supplied to the other of said groups.

18. A method as claimed in claim 17, characterized in that said associating a respective weight factor includes associating respectively different weight factors for the respective subfields supplied to one of said groups during a same field.

19. A method as claimed in claim 17, characterized in that the timing generator supplies an order of weight factors to said at least first and second groups such that a difference in time between sub field periods having equal weight factors is equal for adjacent first electrodes of said plurality of first electrodes.

20. A method as claimed in claim 17, characterized in that the received display information comprises data words having bits with binary coded weights, and the timing generator is configured to generate the weight factors of the display periods within each field period such that each weight factor corresponds with one of the bits.

* * * * *